US007951462B2

(12) United States Patent
English et al.

(10) Patent No.: US 7,951,462 B2
(45) Date of Patent: May 31, 2011

(54) MONOXIALLY-ORIENTED AND ANNEALED FILMS WITH HIGH CROSS MACHINE TOUGHNESS AND RELATED PROCESS

(75) Inventors: Larry L. English, Ringgold, GA (US); Jeffrey W. Adams, Sand Rock, AL (US)

(73) Assignee: Shaw Industries Group, Inc., Dalton, GA (US)

( * ) Notice: Subject to any disclaimer, the term of this patent is extended or adjusted under 35 U.S.C. 154(b) by 363 days.

(21) Appl. No.: 12/108,357

(22) Filed: Apr. 23, 2008

(65) Prior Publication Data

US 2008/0199703 A1 Aug. 21, 2008

Related U.S. Application Data

(62) Division of application No. 11/446,039, filed on Jun. 2, 2006, now Pat. No. 7,611,652.

(60) Provisional application No. 60/739,136, filed on Nov. 22, 2005.

(51) Int. Cl.
*B32B 7/02* (2006.01)

(52) U.S. Cl. ..... 428/516; 428/515; 428/409; 428/397; 442/189

(58) Field of Classification Search ..... 428/34.9, 428/35.1, 500–520
See application file for complete search history.

(56) References Cited

U.S. PATENT DOCUMENTS

| | | | | |
|---|---|---|---|---|
| 2,227,878 | A | 1/1941 | Crooks | |
| 3,336,645 | A | 8/1967 | Mirsky | |
| 3,394,045 | A | 7/1968 | Gould | |
| 3,645,299 | A | 2/1972 | Eichler et al. | |
| 4,100,710 | A | 7/1978 | Kowallik | |
| 4,129,632 | A | 12/1978 | Olson et al. | |
| 4,137,614 | A | 2/1979 | Wolstencroft | |
| 4,188,350 | A | 2/1980 | Vicik et al. | |
| 4,405,775 | A | 9/1983 | Hashimoto | |
| 4,495,124 | A | 1/1985 | Van Erden et al. | |
| 4,906,520 | A | 3/1990 | Kumar | |
| 5,236,963 | A | 8/1993 | Jacoby et al. | |
| 5,314,746 | A | 5/1994 | Johnson et al. | |
| 5,500,980 | A | 3/1996 | Morrow et al. | |
| 5,570,554 | A | 11/1996 | Searer | |
| 5,654,372 | A | 8/1997 | Sadatoshi et al. | |
| 5,724,222 | A | 3/1998 | Hirano et al. | |
| 6,083,611 | A | 7/2000 | Eichbauer et al. | |
| 6,094,337 | A | 7/2000 | Ueda et al. | |
| 6,294,268 | B1 | 9/2001 | Muraoka et al. | |
| 6,326,080 | B1 | 12/2001 | Okayama et al. | |
| 6,752,565 | B2 | 6/2004 | Schrage | |
| 6,881,793 | B2 * | 4/2005 | Sheldon et al. | 525/240 |
| 6,887,567 | B2 | 5/2005 | Morin et al. | |
| 2003/0168776 | A1 | 9/2003 | Brady et al. | |
| 2004/0155372 | A1 | 8/2004 | Allen et al. | |
| 2005/0165173 | A1 | 7/2005 | Autran et al. | |
| 2005/0187351 | A1 * | 8/2005 | Stevens et al. | 525/240 |
| 2005/0234172 | A1 | 10/2005 | Musgrave et al. | |
| 2005/0268571 | A1 | 12/2005 | Magnusson | |
| 2006/0177632 | A1 * | 8/2006 | Jacoby | 428/131 |

OTHER PUBLICATIONS http://www.matweb.com/search/datasheet.aspx?matguid=d2b0782cab6c460abdcf50c97a0249ba&ckck=1
http://www.matweb.com/search/datasheet.aspx?matguid=188d79441b3a44f8a6a853b094929eaa.*

* cited by examiner

*Primary Examiner* — Callie E Shosho
*Assistant Examiner* — Ronak Patel
(74) *Attorney, Agent, or Firm* — Merchant & Gould, P.C.

(57) ABSTRACT

A monoaxially-oriented polymeric film material formed from an impact copolymer and having increased toughness relative to films that are monoaxially-oriented at conventional temperatures.

20 Claims, No Drawings

MONOXIALLY-ORIENTED AND ANNEALED FILMS WITH HIGH CROSS MACHINE TOUGHNESS AND RELATED PROCESS

CROSS-REFERENCE TO RELATED APPLICATIONS

This application is a Divisional of U.S. Utility patent application Ser. No. 11/446,039, filed on Jun. 2, 2006, now U.S. Pat. No. 7,611,652 which claims priority to U.S. Provisional Application No. 60/739,136, filed on Nov. 22, 2005, all of which are incorporated in their entirety in the document by reference.

BACKGROUND

This invention relates to polymer films suitable for slitting into yarns and weaving into fabrics. The production of slit film tape yarns is well known and complete production lines are offered by numerous machinery manufacturers. Slit film tape yarns are commonly used in the production of woven carpet backing, woven geotextiles, woven bags or sacking and concrete reinforcement. A typical raw material for these products is between about a 3 to 4 melt flow index homopolymer polypropylene. For certain products, a 1 melt flow index polymer is used.

One exemplary conventional production method consists of extruding molten polypropylene through a flat die in the form of a molten sheet. The molten sheet thus formed is then rapidly cooled (quenched) in a temperature controlled cold water bath (quench tank) or via chilled casting rollers to form a solid sheet. Dimensions of this sheet are typically in the range of 4 to 12 mils (0.004-0.012 inches) in thickness and range from about 40 to 80 inches in width. Typically, the thickness is determined by the desired end product, and the width is determined by the width of the die.

Following the quenching process, the now solid sheet passes by a vacuum slot system to remove residual water droplets. Subsequently the sheet passes through a blade bar, which typically comprises a plurality of sharp blades, similar to razor blades. These blades are typically spaced from between about 70 to 150 mils (0.075-0.150 inches) apart. Depending on the desired product and width of the formed sheet, there will be from about 400 to 900 individual yarns produced during passage through the blade bar. Typical linear production speed at this point is between about 100 to 200 feet per minute. At this point in the exemplary production process, the film or the slit yarns have not been oriented (drawn) appreciably.

Following passage through the blade bar slitting system, the sheet of undrawn slit film yarns is passed over a slow speed group of rollers, and then passed through an oven that is heated to a desired temperature using hot air circulated by at least one fan, such as a high speed fan. At the exit of the oven, the heated sheet is passed onto a second group of rollers that are run at a substantially higher speed than the slow speed group of rollers. The speed differential between the respective groups of rollers will typically be anywhere from between a 4 to 1 ratio up to about a 10 to 1 ratio, depending on the process conditions, polymer and desired end product. The speed differential is commonly referred to as the "draw ratio." Typically, as the draw ratio increases, the width and thickness of the slit film tapes is reduced.

In order to produce a finished yarn with desirable physical properties, the now drawn yarns are passed over annealing rolls, which are typically a series of heated rollers with independent motor drives. By using a combination of temperature and speed, the yarn is allowed to relax, i.e., shrink, from between about 3% to about 20%. The shrinkage is controlled by reduction of roller speeds as the yarns pass through the annealing roller system. Typical production lines contain from between about 3 to 9 heated rollers in the annealing section. Prior to exiting, the fully drawn and annealed yarns pass over chilled cooling rollers to set the properties of the yarns. During the process of annealing, tensile is reduced, elongation is increased and shrinkage due to exposure to hot air is significantly reduced. In order to produce slit film yarns with the desired properties, a particular combination of quenching temperature, draw ratio, draw temperature, annealing temperature, and percent relaxation is required.

The drawn and annealed yarns leave the cooling rolls and are wound up on a multitude of traverse type spool or bobbin winders. In this step, a core or spool is placed onto a spindle which begins to rapidly rotate and the yarn is laced through a reciprocating yarn guide that rapidly moves back and forth across the face of the spool. The yarn is thus laid onto the bobbin. Following a predetermined time or length schedule, the now full bobbins are manually removed, an empty bobbin is placed onto the winder spindle and a new package of yarn is started up. Depending on the yarn dimensions, all of the bobbins will be replaced every 4 to 6 hours. A single yarn or multiple yarns can be placed onto a singly bobbin. In the one exemplary method, a sheet producing 900 individual yarns wound 2 per bobbin will result in a single production line containing at least 450 traverse winders.

The aforementioned production system is typically run as one continuous operation, with polymer resin or pellets being automatically fed into the extruder, the sheet and slit yarns running down the line through the various operations as described above and finishing as a multitude of bobbins of yarn. This process is generally referred to as yarn extrusion. As is known in the art, polypropylene is highly susceptible to stress-induced crystallization, with the higher draw ratios generating a highly crystalline structure. While the yarns are quite flexible and robust in the length direction, there is very little strength elongation in the width of the tape, which leads to a brittle material that will easily fibrillate, or split lengthwise, under stress.

An alternative to the production method described above is to produce oriented film, roll the oriented film onto mandrels, followed by slitting off line. Industrial processes using this approach that are well known include recording tapes, adhesive tapes, strapping and electronic capacitor insulators. United States patents relating to polypropylene based materials include U.S. Pat. Nos. 5,724,222 to Hirano, et al. and 6,094,337 to Ueda, et al., which describes file production for capacitors; U.S. Pat. Nos. 3,394,045 to Gould and 4,495,124 to Van Erden, et al., which describe strapping manufacture and U.S. Pat. No. 6,326,080 Okayama, et al., which describes film production for packaging materials. An exemplary description is as follows.

In this example, after the molten sheet from the extruder is cooled, the production process comprises orienting and winding the film onto a jumbo film winder. These winders can typically produce rolls 120 inches wide and 60 inches in diameter that weigh upwards of 10,000 lbs. In some of these conventional manufacturing processes, the jumbo rolls of oriented film are subjected to one or more subsequent coating operations. For example, adhesive tapes are coated with a sticky material while a recording tape is coated with a metal oxide layer and a protective layer. As a final process, the full width oriented film is passed through a blade bar or other cutting device and converted into a narrower width tapes that exemplarily range from about ⅛ inch wide (audio cassette tapes) up to an inch or more (adhesive tapes).

All of the above mentioned products are biaxially oriented, which means that the film is oriented lengthwise or in the machine direction, as well as being oriented in the transverse or width direction. These two orientation steps can be performed in various sequences as required by the product or production machinery. The width-wise orientation step produces films with excellent cross machine properties. A drawback of width orientation is that these machines are normally exceedingly large, capital intensive and costly to operate.

Numerous patent references describe slitting of oriented plastic films into tapes with properties suitable for use in textile processes. U.S. Pat. No. 4,129,632 to Olson, et al., for instance, describes production of oriented films, slitting into narrow width rapes and winding the resulting tapes onto yarn traverse winders suitable for use in carpet backing applications. In another example, U.S. Pat. No. 3,336,645 to Mirsky describes slitting a sheet of film into tapes and directly winding them onto a beam for use on weaving or warp knitting machines. Further, U.S. Pat. No. 4,137,614 to Wolstencroft uses a modified film feeding layout and threading pattern where multiple rolls of film are slit and the tapes are then wound onto a beam. U.S. Pat. No. 4,906,520 to Kumar describes slitting oriented films to produce tape, and by an unspecified method, the tapes are introduced to a loom to be woven. Finally, U.S. Pat. No. 3,645,299 to Eichler, et al. describes placing a roll of oriented film on the loom with the blade bar mounted on the loom itself.

These exemplary processes noted above offer the advantage of reduced floor space (no traverse winders or beaming creels) and lower labor requirement. However, the processes described all suffer from one or more deficiencies in either materials or process limitation. For example, the use of monoaxially oriented films in these processes is limited to slow slitting speeds, the relatively high cost of biaxially films that are normally required for high slitting speeds, and the like. These deficiencies are serious enough that none of these exemplary processes are currently being operated commercially in the U.S.

It is known that monoaxially oriented homopolymer polypropylene tends to produce brittle products that tend to split lengthwise. Further, it is difficult to produce an acceptable film from a substantially 100% homopolymer polypropylene; nor, would such a film pass through slitter blades at any commercially viable speed. Various methods to reduce the brittle nature of oriented films are known in the art, such as, for example, the blending of random copolymers of ethylene/propylene or ethylene polymers of various densities with the polypropylene. A major drawback to these additive materials is their low melting point, which leads to films that have unacceptably high thermal shrinkage properties for the products described herein. Other examples of materials used to reduce brittleness are described in U.S. Pat. Nos. 5,236,963 to Jacoby, et al. and 6,881,793 to Sheldon, et al. Both of these disclosures address the use of blends of flexible elastomeric type materials to soften and increase extensibility of polymer films.

Further, U.S. Pat. Nos. 4,188,350 to Vicik, et al. and 6,083,611 to Eichbauer, et al. describe production of a multilayer shrink film using an impact copolymer in one or more layers. In another example; U.S. Pat. No. 5,654,372 to Sadatoshi, et al. describes a melt-kneaded process to product an impact copolymer for films. Additionally, U.S. Pat. No. 5,314,746 to Johnson, et al. describes film made from a unique crystalline propylene/ethylene copolymer as the continuous phase with a rubbery propylene/ethylene copolymer s the dispersed phase, in which the continuous phase melts below 160° C.

While attempts have been made heretofore to manufacture polymer films having sufficient cross machine toughness to allow high speed slitting of the films into tape yarns, the art has not provided a facile means or device by which to do so.

SUMMARY

It is therefore, an aspect of the present invention to provide a monoaxially oriented film with sufficient cross machine properties that will allow low and high speed slitting of tape yarns.

It is another aspect of the present invention to provide a monoaxially oriented and annealed film with low thermal shrinkage properties.

A further aspect is to produce woven fabrics from the slit tape yarns having improved properties.

Yet another aspect of the present invention to provide a process for the manufacture of monoaxially oriented and annealed film with low thermal shrinkage properties.

A still further aspect is to utilize polyolefin based impact copolymers, combined with processing conditions disclosed herein to provide films with improved cross machine toughness properties.

At least one or more of the foregoing aspects, together with the advantages thereof over the known are relating to forming polymer films, which shall become apparent from the specification which follows, are accomplished by the invention as hereinafter described and claimed.

In one embodiment of the present invention, a polymeric film material comprising an impact copolymer is disclosed. In one aspect, the film is monoaxially-oriented and has an increased toughness. In one example, the toughness of the polymeric film is at least about 40 percent higher than toughness for films that are monoaxially-oriented at conventional temperatures.

Alternatively, the present invention also provides a tape yarn produced from a polymeric film material that is monoaxially-oriented and comprises an impact copolymer. In one example, the film material has a toughness that is at least about 40 percent higher than toughness for comparable films that are monoaxially-oriented at conventional temperatures.

In a further aspect of the invention, a woven fabric is produced from tape yarns derived from a polymeric film material that is monoaxially-oriented and comprises an impact copolymer. In an exemplary aspect the film material has an increased toughness when compared to films that are monoaxially-oriented at conventional temperatures.

In another aspect, a production process for imparting high cross machine toughness to polymer films is disclosed. In one aspect, the production process comprises forming a film from a blend of an olefin-based polymer and an impact copolymer, subjecting the film to monoaxial orientation involving drawing at stages where the film is subjected to a stage of preheating, then at least one stage of drawing and then a stage of tempering; and annealing the film. In this aspect, for example, during the stage of tempering, the film is conducted at temperatures of from between about 20 to about 45 percent lower than the temperature at which the film is subjected to during the stage of drawing.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

The present invention can be understood more readily by reference to the following detailed description, examples, and claims, and their previous and following description.

Before the present compositions, devices, and/or methods are disclosed and described, it is to be understood that this invention is not limited to the specific articles, devices, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used herein, the singular forms "a," "an" and "the" include plural referents unless the context clearly dictates otherwise. Thus, for example, reference to a "permeant delivery reservoir" includes aspects having two or more permeant delivery reservoirs unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

As used herein, the term "machine direction" or MD means the length of a film in the direction in which it is produced. The term "cross machine direction" or CD means the width of the film, i.e., a direction generally perpendicular to the MD.

Films according to one embodiment of the present invention comprise a polymer composition that are processed to become monoaxial orientated. The films produced by the exemplified production process described below are capable of high, or low, speed slitting to form tapes yarns that can be woven into fabrics for a variety of purposes.

In one aspect, the polymer composition comprises an impact copolymer. Exemplary impact copolymers can comprise heterophasic copolymers, which are commonly referred to as impact copolymers and the terms have equivalent meanings as used herein. Heterophasic copolymers characteristically retain the high melting point (i.e., greater than about 160° C.) of propylene homopolymers, while also exhibiting resilient properties. Generally, exemplary polymer compositions comprise a continuous phase of polypropylene with a dispersed phase of propylene/ethylene rubber.

In another aspect, the polymer composition may optionally comprise an olefin-based polymer comprising a C2 to C8 olefin homopolymer, with polypropylene being preferred. While olefin polymers are preferred, it is also contemplated that the composition could also comprise polyester or nylon homopolymers, blended with suitable copolymers.

In a further aspect, the melt flow index, or MFI, for the impact copolymers ranges between about 0.6 and 3.5. Generally, the MFI for the polypropylene homopolymers ranges between about 0.6 and 6. In one aspect, the selected MFI of the impact copolymer can be determined by the MFI of the homopolymer used in the blend as well as the percentage of impact copolymer in the blend. Optionally, the selected MFI of the homopolymer can be determined by the MFI of the impact copolymer used in the blend as well as the percentage of homopolymer in the blend. In one exemplary aspect, the resulting film composition can have an MFI of between about 1.7 to about 2.5 measured on the finished film.

Optionally, the two polymer components can be blended in amounts of from between about 0 to about 70 parts by weight of the olefin-based polymer, including additional amounts as 5, 10, 15, 20, 25, 30, 35, 40, 45, 50, 55, 60, and 65 parts by weight of the olefin-based polymer, and from between about 30 to about 100 parts by weight of the impact copolymers, including additional amounts as 35, 40, 45, 50, 55, 60, 65, 70, 75, 80, 85, 90, and 95 parts by weight of the impact copolymers, to total 100 parts by weight. In one exemplary aspect, the blend is approximately 50/50 parts by weight of the olefin-based polymer and the impact copolymers. Blending cam be conducted in a conventional fashion, by means known to those skilled in the art.

The blended polymer pellets are then fed to an extruder, melted and extruded into sheets or films, again as is customary in the art. Accordingly, the extruded films can exemplarily range from between about 40 to about 80 inches wide, depending upon the equipment and from about between 5 to about 18 mils in thickness, depending upon equipment settings. It will be appreciated that width and thickness of such extruded films do not constitute a limitation of the present invention.

In another aspect, the formed film is then subjected to monoaxial orientation by the use of a machine direction orientor, an "MDO." As used herein, the term "MDO" designates either equipment, i.e., a machine direction orientor, or a process, i.e., a machine direction orientation. U.S. Pat. Nos. 4,405,775 Hashimoto to and 5,724,222 to Hirano, et al., disclose exemplary conditions that are typical for machine direction orientation of polypropylene films, the subject matter of which is incorporated herein by reference in their entirety.

These MDO's utilize a series of heated rollers with increasing speeds and temperatures to effect monoaxial orientation of the films. A typical layout consists of 2 or more preheat rollers, followed by a series of heated rollers that run at progressively faster speeds and higher temperatures. In one aspect, as compared to conventional hot air drawing, the use of an MDO for drawing film allows for the use of draw rollers that are spaced generally less than about 100 mils (0.100 inches) apart, which provides for very tight control of the film and for very uniform drawing forces. Further, use of an MDO allows for the substantial reduction in width loss due to drawing. Comparatively, drawing through a hot air oven results in film width reduction of at least about 50%, while there is no more than about a 15% width loss with an MDO.

In another aspect, the use of an MDO to monoaxially orient the film results in improved cross machine properties compared to film oriented using a hot air drawing. As an example, orienting the film using an MDO provides about twice the cross machine tensile and elongation and about six times the cross machine toughness compared to film produced using a hot air oven draw process. Further, an exemplary MDO produced film allows the slitter speed to increase from the nominal less than 30 feet per minute for hot air drawn film to over about 100 yards per minute on MDO films that produced similar yarn properties.

Conventionally, MDO's are operated at varying draw ratios and temperatures. In one aspect, the selected draw ratios for can range from between about 3.5:1 to about 8.5:1, including additional draw ratios as 4.0:1, 4.5:1, 5.0:1, 5.5:1, 6.0:1, 6.5:1, 7.5:1, and 8.0:1. It is contemplated that the selected draw ratio will vary depending on the end product requirements. For example, and not meant to be limiting, carpet backing can use draw ratios of about between about 3.5 to about 4.5, including draw ratios as 4.0:1 whereas high strength products such as bags or geotextiles can use draw ratios in the range from about 6 to about 8.5, including draw ratios as 6.5:1 and 7.5:1. Also, in a further aspect, a plurality of stages of drawing temperatures can be utilized. In one exemplary aspect, the plurality of stages can comprise three stages of drawing temperatures such as, for example, a pre-heat stage, the heated drawing stage, and a tempering stage.

In this aspect, in the pre-heat stage, the selected temperatures can range from between about 130 to about 140° C., including additional temperatures as 131° C., 132° C., 133° C., 134° C., 135° C., 136° C., 137° C., 138° C., and 139° C., with 135° C. being preferred. In one aspect, the pre-heat stage comprised a plurality of pre-heat rolls. In one example, the plurality of pre-heat rolls comprises a pair of pre-heat rolls.

In a further aspect, in the heated drawing stage, the temperatures can range from between about 143° C. to about 155° C., including additional temperatures as 144° C., 145° C., 146° C., 147° C., 148° C., 149° C., 150° C., 151° C., 152° C., 153° C., and 154° C. In this aspect, the heated drawing stage in configured to allow for both an initial slow draw and a subsequent fast draw. Conventionally, MDO operations are conducted at a fairly constant temperature across the draw process, the production process of the present invention contemplates the use of an increased temperature at the first or initial slow draw that occurs after the pre-heat stage, which is followed by a slight decrease in temperature at the second or fast draw after the first draw. Accordingly, temperatures for the slow draw can range from between about 146° C. to about 155° C., including additional temperatures as 147° C., 148° C., 149° C., 150° C., 151° C., 152° C., 153° C., and 154° C., with 154° C. being preferred. For the fast draw, temperatures for the fast draw can range from between about 143° C. to about 152° C., including additional temperatures as 144° C., 145° C., 146° C., 147° C., 148° C., 149° C., 150° C., and 151° C., with 150° C. being preferred.

In a further aspect, the temperatures in the tempering stage can typically range from between about 70° C. to about 130° C., including additional temperatures as 75° C., 80° C., 85° C., 90° C., 95° C., 100° C., 105° C., 110° C., 115° C., 120° C., and 154° C., with 95° C. being preferred. Typically, all drawing rolls of MDO's are operated at temperatures of from between about 127° C. to about 140° C. where all rollers are either maintained at the same temperature or slightly increasing temperatures from roll to roll as it proceeds from the entrance to the exit of the MDO. However, according to one aspect of the production process of the present invention, the tempering stage of the MDO utilizes a much lower temperature than used in the drawing stage.

While an exemplary range of temperatures has been disclosed for the tempering stage more generally, tempering should be conducted at a temperature within a range of between about 20 to about 45 percent lower than the temperature at which the final draw is conducted, including percentages of 25, 30, 35, and 40 percent, with a range of between about 30 to about 35 percent being preferred. Similarly, for the slow draw portion of the drawing stage, temperature increases can be within a range of between about 12 to about 19 percent higher than the temperature at which the pre-heat stage is conducted, including percentages of 13, 14, 15, 16, 17, and 18, with 14 percent being preferred. In another exemplary aspect, for the fast draw portion of the drawing stage, temperature decreases are in a range of between about 2 to 7 percent lower than the temperature at which the preceding slow draw portion of the drawing stage is conducted, including percentages of 3, 4, 5, and 6 percent, with 2.5 percent being preferred.

In various exemplary aspects, some of the improved cross machine properties that can be expected for the films of the present invention included improved toughness in the cross machine direction and generally an increase in maximum elongation measured on the stress strain curve. An ASTM D4595 testing procedure was used to measure the formed film's physical properties. The ASTME D4595 test was applied to 4×5/32 inch wide test strips of the respective films. Exemplified films exhibited CD toughness values that ranged from between about 5,000 to 16,000 lbs/in$^2$, with preferred toughness values in excess of 12,000 lbs/in$^2$. Toughness values below 3,000 lbs/in$^2$ produced films that could not be slit at high speed, while toughness values over 12,000 lbs/in$^2$ consistently ran at high slitting speeds. For example, conventional hot air drawn films produced only about 400 lbs/in$^2$, and they were virtually impossible to slit. Using the production process of the present invention, improvement in toughness for the produced films is at least about 400 percent better than toughness for films that are hot air drawn and is least about 40 percent better than toughness for films processed through an MDO at conventional temperatures. More generally, the improvement in toughness for films produced via the process of the present invention is from about 400 to about 600 percent better than toughness for films that are hot air drawn and is from about 40 to 80 percent better than toughness for films processed through an MDO at conventional temperatures.

EXAMPLES

In order to demonstrate the efficacy of the polymer blends described herein and the process of extruded films, a number of samples were prepared and tested, as described herein below. The examples have been provided to demonstrate practice of the present invention and should not be construed as limitations of the invention or it practice.

Useful impact copolymers commercially available include Total 4180 and Dow Chemical 7CO6. Polypropylene homopolymer was obtained from ExxonMobil, product code, PP2252E4.

A 50/50 blend of polypropylene homopolymer, MFI of 4, and impact copolymer, Total 4180, having an MFI of 0.8 was prepared. Such blends are disclosed in U.S. Pat. No. 6,881,793 to Sheldon, et al., the subject matter of which is incorporated herein by reference. Two films were extruded; Example 1 was subjected to monoaxial orientation on an MDO utilizing a conventional heat profile as a control, while Example 2 was subjected to monoaxial orientation on an MDO utilizing the tempering stage, according to the present invention. Temperatures for the three stages for both Examples 1 and 2 were as follows.

Temperature Profiles

| Example No. | Pre-Heat Stage | First Draw of Drawing Stage | Second Draw of Drawing Stage | Exit | Tempering Stage |
|---|---|---|---|---|---|
| 1 | 127° C. | 127° C. | 127° C. | 127° C. | |
| 2 | 127° C. | 154° C. | 150° C. | | 95° C. |

In a further aspect of the invention, once the film has been monoaxially oriented, it is subsequently annealed. One skilled in the art will appreciate that the process used to reduce shrinkage in film or slit tape yarn is referred to as annealing. Annealing is similar to a heat setting operation used on textile fabrics, but with one important difference. When fabric is heat set, it is normally held under tension in both the widthwise and lengthwise dimensions. When slit tape yarns or films are annealed, the annealing process is designed to allow for lengthwise shrinkage while simultaneously being exposed to high heat. This lengthwise shrinkage allows the polymer molecules to relax, re-orient, and form different crystallites at the molecular level. Conventionally, the amount of annealing is measured as "percent annealing" and is understood to be the amount of shrinkage or relaxation as the yarn or film passes through the annealing process.

In operation, several parameters influence the percent annealing. One of these parameters is draw ratio. For example, a higher draw ratio will produce yarns or films that tend to shrink more. Another parameter that affects percent annealing is annealing temperature. For example, a higher temperature on the annealing rollers will typically induce more shrinkage. In another aspect, affecting the polymer melting point will affect the percent annealing, e.g., a lower melting point polymer will shrink more at the same annealing temperature than higher melting point polymers.

As one would appreciate, the annealing step varies according to the base properties of the oriented film or yarn (i.e., draw ratio and polymer type) and also by the desired properties in the finished material. In various examples, typical finished shrinkages measured on the post annealed yarn or film would be less than 2% and preferably less than 1.5% measured at 135° C. Depending on the process and material, percent annealing could range from as low as between about 2 to 4 percent up to between about 18 to 20%. These exemplary percentages of percent annealing typically result in a substantially stable film or yarn with finished shrinkage percentages below 2%.

It is known that there are numerous interactions between temperature, speed, film thickness, and roller configuration that determine how much annealing a given film or yarn can accept. For example, too hot or too little speed reduction can lead to sheet breaks. Also, too cool or too much speed reduction can lead to the sheet "floating" over the heated rollers. Those skilled in the art can determine the optimum speed and temperature required to obtain the desired percent anneal.

Nevertheless, by way of example, a typical set of conditions for annealing would be as follows:

Film entry temperature into annealing roller section: 75° C. to 150° C.

Number of heated annealing rollers: 3 to 9

Film entry speed into annealing roller section: 250 to 410 meters/minute

Annealing roller temperature: 145° C. to 175° C.

Cooling roll temperature (at the exit of the annealing section): 15° C. to 35° C.

Number of cooling rollers: 2 to 4

Film exit temperature from cooling rollers: 20° C. to 40° C.

Film exit speed from cooling rollers: 0.85 to 0.92 times the film entry speed

Of course, the above conditions are illustrative only and are not intended to constitute any limitation on practice of the present invention. Generally speaking, the film should be annealed and those skilled in the art can determine the steps and conditions necessary without departing from the scope of the invention.

The oriented and annealed films are typically wound onto mandrels for subsequent use as films, or, they can be slit to form tape yarns. In one aspect, the slitting into tape yarns is preferably done just prior to beaming, for weaving operations, in which instance individual winding onto bobbins and subsequent creeling operations are avoided. Nonetheless, tape yarns produced from the films of the present invention can be wound onto bobbins if desired. One application would be to provide unique fill yarns for a weaving application. Uses for the films include, for example and without limitation, coating substrates, lamination components and cross ply composite structures.

In a further aspect, the present invention also provides a variety of woven or nonwoven composite laminate fabrics, including open weave and closed weave patterns. Such fabrics are used in a multitude of products including a host of geotextiles; as filtration media; as bags and sacks for storage; as carpet backing, such as for example and without limitation, primary and/or secondary materials.

Thus, it should be evident that the films of the present invention have greater cross machine properties than extruded films that are processed by hot air and accordingly, the films can be slit at higher speeds into tape yarns of high quality. In similar fashion, it should be evident that the process of the present invention is highly effective in producing such films. In is contemplated that the process of the present invention is particularly suited for processing polymer films comprising impact copolymers, as well as blends of impact copolymers and olefin-based homopolymers, but is necessarily limited thereto. Films and tape yarns according to the present invention can be processed on conventional equipment for the extrusion of films and their subsequent slitting, where desired and thus, the present invention is not necessarily limited by the use of such equipment.

Throughout this application, various publications are referenced. The disclosures of these publications in their entireties are hereby incorporated by reference into this application in order to more fully describe the state of the art to which this invention pertains.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention.

Moreover, although specific terms are employed herein, they are used only in a generic and descriptive sense, and not for the purposes of limiting the described invention.

What is claimed is:

1. A monoaxially-oriented polymeric film comprising at least one impact copolymer, wherein the polymeric film exhibits a cross-directional machine toughness greater than 3000 lbs/in$^2$ as measured according to ASTM-D4595 testing procedures on a 4×5/32 inch wide sample of the monoaxially-oriented polymeric film.

2. The monoaxially-oriented polymeric film of claim 1, further comprising an olefin-based polymer blended with said impact copolymer.

3. The monoaxially-oriented polymeric film of claim 2, wherein said blend comprises:

a) from greater than 0 to about 70 parts by weight of said olefin-based polymer; and b) at least about 30 parts by weight of said impact copolymer, wherein the total of a) and b) is 100 parts by weight.

4. The monoaxially-oriented polymeric film of claim 2, wherein said olefin-based polymer is polypropylene and said impact copolymer comprises a continuous phase of polypropylene with a dispersed phase of propylene/ethylene rubber.

5. The monoaxially-oriented polymeric film of claim 2, wherein said olefin-based polymer has a melt flow index of from about 0.6 to about 5 and wherein said impact copolymer has a melt flow index of from about 0.6 to about 3.5.

6. The monoaxially-oriented polymeric film of claim 2, wherein the olefin-based polymer comprises a $C_2$-$C_8$ olefin homopolymer.

7. The monoaxially-oriented polymeric film of claim 1, having a melt flow index of from about 1.7 to about 3.2.

8. The monoaxially-oriented polymeric film of claim 1, wherein the impact copolymer comprises a heterophasic copolymer.

9. The monoaxially-oriented polymeric film of claim 1, wherein the impact copolymer exhibits a melting point of at least about 160° C.

10. The monoaxially-oriented polymeric film of claim 1, wherein the cross-directional machine toughness is greater than 5000 lbs/in$^2$.

11. The monoaxially-oriented polymeric film of claim 1, wherein the cross-directional machine toughness is greater than 12,000 lbs/in$^2$.

12. The monoaxially-oriented polymeric film of claim 1, wherein the cross-directional machine toughness is in the range of from about 5,000 lbs/in$^2$ to about 16,000 lbs/in$^2$.

13. The monoaxially-oriented polymeric film of claim 1, wherein the film exhibits a shrinkage percentage less than approximately 2% when measured at 135° C.

14. A monoaxially-oriented polymeric film comprising:

an olefin-based polymer; and an impact copolymer having a melting point of at least about 160° C.;

wherein the polymeric film exhibits a cross-directional machine toughness greater than 3000 lbs/in$^2$ as measured according to ASTM-D4595 testing procedures on a 4×5/32 inch wide sample of the monoaxially-oriented polymeric film.

15. The monoaxially-oriented polymeric film of claim 14, wherein the film comprises:

a) from greater than 0 to about 70 parts by weight of said olefin-based polymer; and b) at least about 30 parts by weight of said impact copolymer, wherein the total of a) and b) is 100 parts by weight.

16. The monoaxially-oriented polymeric film of claim 14, wherein said olefin-based polymer is polypropylene and said impact copolymer comprises a continuous phase of polypropylene with a dispersed phase of propylene/ethylene rubber.

17. The monoaxially-oriented polymeric film of claim 14, wherein the olefin-based polymer comprises a $C_2$-$C_8$ olefin homopolymer.

18. The monoaxially-oriented polymeric film of claim 14, wherein the polymeric film exhibits a shrinkage percentage less than approximately 2% when measured at 135° C.

19. A monoaxially-oriented polymeric film comprising:

an olefin-based polymer comprising a $C_2$-$C_8$ olefin homopolymer; and an impact copolymer comprising a continuous phase of polypropylene with a dispersed phase of propylene/ethylene rubber;

wherein the polymeric film exhibits a cross-directional machine toughness in a range of from about 3,000 lbs/in$^2$ to about 16,000 lbs/in$^2$ as measured according to ASTM-D4595 testing procedures on a 4×5/32 inch wide sample of the monoaxially-oriented polymeric film.

20. The monoaxially-oriented polymeric film of claim 19, wherein said olefin-based polymer is polypropylene.

* * * * *